US007951435B2

(12) United States Patent
Nishimura

(10) Patent No.: US 7,951,435 B2
(45) Date of Patent: May 31, 2011

(54) INKJET RECORDING MATERIAL

(75) Inventor: Shigeki Nishimura, Shiga (JP)

(73) Assignee: Mitsubishi Plastics, Inc., Tokyo (JP)

( * ) Notice: Subject to any disclaimer, the term of this patent is extended or adjusted under 35 U.S.C. 154(b) by 993 days.

(21) Appl. No.: 11/573,835

(22) PCT Filed: Aug. 18, 2005

(86) PCT No.: PCT/JP2005/015064

§ 371 (c)(1),
(2), (4) Date: Jun. 13, 2007

(87) PCT Pub. No.: WO2006/019134

PCT Pub. Date: Feb. 23, 2006

(65) Prior Publication Data

US 2007/0298195 A1 Dec. 27, 2007

(30) Foreign Application Priority Data

Aug. 19, 2004 (JP) ..... 2004-239371

(51) Int. Cl.
*B41M 5/00* (2006.01)

(52) U.S. Cl. ..... 428/32.26; 428/32.28; 428/32.3; 428/32.34; 428/32.38

(58) Field of Classification Search ..... 428/32.26, 428/32.28, 32.3, 32.34, 32.38
See application file for complete search history.

(56) References Cited

U.S. PATENT DOCUMENTS

| | | | |
|---|---|---|---|
| 6,017,611 A | 1/2000 | Cheng et al. | |
| 6,197,409 B1 | 3/2001 | Bodager et al. | |
| 6,716,494 B2 | 4/2004 | Nakanishi et al. | |
| 2003/0035038 A1 | 2/2003 | Nakajima | |
| 2003/0153666 A1 * | 8/2003 | Farooq | 524/430 |
| 2003/0175450 A1 * | 9/2003 | Obayashi et al. | 428/32.1 |

FOREIGN PATENT DOCUMENTS

| | | |
|---|---|---|
| CN | 1352599 | 6/2002 |
| CN | 2581178 | 10/2003 |
| EP | 1232873 | 8/2002 |
| JP | 58-134785 A | 8/1983 |
| JP | 7-195826 | 8/1995 |
| JP | 09-183929 A | 7/1997 |
| JP | 10-138633 A | 5/1998 |
| JP | 10-250028 | 9/1998 |
| JP | 11-058934 A | 3/1999 |

(Continued)

OTHER PUBLICATIONS

Office Action issued Feb. 8, 2011, in Japan Patent Application No. 2006-531850, filed Aug. 17, 2006 (with English-language translation).

*Primary Examiner* — Betelhem Shewareged

(74) *Attorney, Agent, or Firm* — Oblon, Spivak, McClelland, Maier & Neustadt, L.L.P.

(57) ABSTRACT

Disclosed is an inkjet recording material comprising at least a base layer and an ink receiving layer. The ink receiving layer is composed of a mixture of a hydrophilic component containing a hydrophilic resin and a hydrophobic resin having hot-melt property. And the mass ratio between said hydrophilic component and said hydrophobic resin having hot-melt adhesive property in the mixture is from 60:40 to 20:80 (the hydrophilic component:hydrophobic resin). The inkjet recording material is excellent in moisture resistance, while exhibiting high ink absorption capacity.

22 Claims, 1 Drawing Sheet

FOREIGN PATENT DOCUMENTS

| | | | |
|---|---|---|---|
| JP | 11-105208 | | 4/1999 |
| JP | 2002-067481 | A | 3/2002 |
| JP | 2002-240411 | A | 8/2002 |
| JP | 2003-312130 | A | 11/2003 |
| JP | 2004-50509 | | 2/2004 |
| JP | 2004-154978 | | 6/2004 |
| JP | 2004-181935 | | 7/2004 |
| JP | 2004-188891 | | 7/2004 |

* cited by examiner

INKJET RECORDING MATERIAL

CROSS-REFERENCE TO PRIOR APPLICATIONS

This is a U.S. national phase application under 35 U.S.C. §371 of International Patent Application No. PCT/JP2005/015064 filed Aug. 18, 2005, and claims the benefit of Japanese Application No. 2004-239371 filed Aug. 19, 2004. The International Application was published in Japanese on Feb. 23, 2006 as International Publication No. WO/2006/019134 under PCT Article 21(2), the content of which is incorporated herein in its entirety.

The present invention relates to an inkjet recording material suitably used for display materials and the like.

BACKGROUND ART

Inkjet recording system, since it realizes accurate recording with low cost, is in general widely spread. Recently, thanks to the improvement of hardware like inkjet head and of software like raster image processor, furthermore high-performance inkjet printers are developed. According to this development, a development of inkjet recording materials, which enable to record output images transferred from the printer with high quality image and which enable to be preservative over the long period of time, has been proceeding. Consequently, many display materials with use of inkjet recording materials for like billboard and display panel have been seen in the market.

Ink receiving layer of inkjet recording materials is mainly classified into two types: i.e. "void type" where porous inorganic particles for absorbing ink are bound with hydrophobic resin binder; and "swelling type" where hydrophilic resin itself absorbs ink. From the view point of drying property and water resistance of ink, the void type ink receiving layer is now becoming the mainstream.

However, as the void type inkjet recording materials having hydrophobic resin in the ink receiving layer thereof adopt an ink absorbing method by capillary phenomenon through holes of porous inorganic particles, the ink absorbent amount is limited. Thereby, for the application of commercial-use display materials which require to have high ink concentration and tone so as to be seen well from the distance, absorbent amount thereof is not sufficient. In order to increase the absorbent amount of the void type ink receiving layer, thickening the ink receiving layer can be considered. Nevertheless, since the void type ink receiving layer is made by the solution coating in the water-based solvent, from the view point of high boiling point of water and the bad coating property, the coating amount is limited, therefore it is not easy to realize to thicken the ink receiving layer.

On the other hand, as for ink receiving layers containing hydrophilic resin, the resin itself forming the ink receiving layers can absorb ink, this type of layer is excellent in ink absorption capacity and is suitable for the use of like display materials which require high ink concentration and tone.

Display materials are used under a harsh environment such as outdoor. When an inkjet recording material is used as a display material, in order to give damage resistance and weatherability, a surface protective layer needs to be provided. As an inkjet recording material which is capable to easily provide this protective layer, Japanese Patent Application Laid-Open (JP-A) No. 2002-67481 (JP '481) discloses an inkjet recording material. The base layer of the inkjet recording material is used as the surface protective layer thereof; this is obtained by back-printing (mirror-like printing) the images to the thermosensitive adhesive ink receiving layer, then thermally adhering the ink receiving layer to the subjects to be adhered.

DISCLOSURE OF THE INVENTION

Problems to be Solved by the Invention

However, JP '481 only discloses a recording material having an ink receiving layer whose thermosensitive adhesive resin is either hydrophilic resin only or hydrophobic resin only. Single usage of thermosensitive adhesive hydrophilic resin has a problem of swelling caused by the moisture from the high water absorption property thereof, thereby the adhesive property declines over the period of time. Particularly, when the hydrophilic resin is set under a harsh environment like the way display materials usually exposed, the resin is immediately peeled from the adhered subject, which is not a suitable material for the use under such circumstances. While, the so-called "void type" recording material having hydrophobic resin to which water absorption filler is added, as mentioned above, has a limit in its ink absorbent amount. Thereby, this type of recording material is lack in ink concentration and tone; hence it is not a suitable material for the use of display materials.

Moreover, in display materials these days, in order to enhance sharpness and coloration, more ink is injected than ever before. In addition, from the view point of durability (color fading, blurring, and so on) of ink itself, pigment ink is often used. When dye ink is used, even though the large quantity of ink is injected to the ink receiving layer, the injected dye ink is absorbed within the ink receiving layer. Thus, there is no problem caused at a time when the ink receiving layer is adhered to the other material to make a display material.

On the other hand, when a large quantity of pigment ink is injected, the ink receiving layer does not absorb the pigment ink, a pigment ink layer is formed on the surface of ink receiving layer. When a display material is formed in such a circumstance, the ink receiving layer needs to go through this pigment ink layer and to be adhered to the other material. For this reason, an inkjet recording material, which is capable to favorably adhere so as to make display materials even under the circumstances that the large quantity of pigment ink is injected, is required.

Accordingly, an object of the present invention is to provide an inkjet recording material which has high ink absorption property and is excellent in moisture resistance adhesiveness, and which is capable to obtain high adhesive strength when a large quantity of pigment ink is injected.

SUMMARY OF THE INVENTION

The present invention is described as follows.

The first aspect of the present invention provides an inkjet recording material comprises at least a base layer and an ink receiving layer, wherein the ink receiving layer is composed of a mixture of a hydrophilic component containing a hydrophilic resin and a hydrophobic resin having hot-melt adhesive property, and the mass ratio between the hydrophilic component and the hydrophobic resin having hot-melt adhesive property in the mixture is from 60:40 to 20:80 (the hydrophilic component:the hydrophobic resin). According to the invention, this inkjet recording material is excellent in moisture resistance adhesiveness, while exhibiting high ink absorption capacity.

In the first aspect of the invention, the hydrophilic resin is preferably a resin composed of a repeating unit represented by the following general formula (1).

$$-[A^1X^1A^1R^1]- \quad (1)$$

[In the formula (1), $X^1$ is a residue of an organic compound having two activated hydroxyl groups, $R^1$ is a dicarboxylic compound residue or a diisocyanate type compound residue, and $A^1$ is represented by the following general formula (2).]

$$-(CH_2CH_2O)_a-(CH_2\overset{\overset{Z}{|}}{C}HO)_b-(CH_2CH_2O)_c- \quad (2)$$

[In the formula (2), Z is a hydrocarbon group of carbon number 2 or more; a, b, and c each is an integer number 1 or more; and a mass ratio calculated with a, b, and C, namely, {44×(a+c)/(molecular mass of alkylene oxide of carbon number 4 or more)×b} is from 80/20 to 94/6. Further, value of c/(a+c) is 0.5 or more and less than 1.0.]

By using such a hydrophilic resin, it is possible to provide an inkjet recording material which is excellent in ink absorption capacity and productivity.

In the first aspect of the invention, the hydrophilic resin is preferably any one of resins selected from a group consisting of polyvinyl alcohol, polyvinyl pyrrolidone, carboxymethyl cellulose, or mixture of two or more resins thereof. By using such resins as the hydrophilic resin, it is possible to give high ink absorption capacity to the ink receiving layer.

In the first aspect of the invention, the hydrophobic resin having hot-melt adhesive property is preferably any one of resins selected from a group consisting of ethylene-vinyl acetate copolymer, polyester, ethylene-acrylic acid copolymer, ethylene-ethyl acrylate copolymer, or mixture of two or more resins thereof. Accordingly, it is possible to give higher adhesive property to the ink receiving layer.

In the first aspect of the invention, the hydrophilic component may contain porous inorganic particles. Further, the porous inorganic particles are preferably silica and/or alumina. Accordingly, it is possible to give higher ink absorption capacity to the ink receiving layer.

In the first aspect of the invention, the ink receiving layer preferably contains cationic resin. Accordingly, it is possible to prevent blurring of ink and to enhance fixing property.

In the first aspect of the invention, the hydrophilic resin, and the hydrophobic resin having hot-melt adhesive property preferably form a cross-linked structure. Accordingly, it is possible to enhance structural bound strength between the hydrophilic resin, and hydrophobic resin having hot-melt adhesive property both in the ink receiving layer. Moreover, the cross-linked structure can be suitably formed by adding from 0.1% by mass to 10% by mass of hydrogen abstraction type photo-radical polymeric initiator and by radiating ultraviolet-ray thereafter.

The second aspect of the present invention provides an inkjet recording material comprises at least a base layer and an ink receiving layer, wherein the melting point of resin composing the ink receiving layer is between 40° C. and 55° C., and melting energy of the same is between 60 J/g and 90 J/g. Accordingly, it is possible to provide an inkjet recording material which can obtain high adhesive strength even at the time of printing with high concentration of pigment ink.

In the second aspect of the invention, the ink receiving layer is preferably a mixture of a hydrophilic resin having hot-melt adhesive property, and a plasticizer component. Accordingly, it is possible to obtain high adhesive strength at the time of printing with high concentration of pigment ink.

In the second aspect of the invention, the hydrophilic resin having hot-melt adhesive property is preferably a resin composed of a repeating unit represented by the following general formula (1).

$$-[A^1X^1A^1R^1]- \quad (1)$$

[In the formula (1), $X^1$ is a residue of an organic compound having two activated hydroxyl groups, $R^1$ is a dicarboxylic compound residue or a diisocyanate type compound residue, and $A^1$ is represented by the following general formula (2).]

$$-(CH_2CH_2O)_a-(CH_2\overset{\overset{Z}{|}}{C}HO)_b-(CH_2CH_2O)_c- \quad (2)$$

[In the formula (2), Z is a hydrocarbon radical of carbon number 2 or more; a, b, and c each is an integer number 1 or more; and a mass ratio calculated with a, b, and c, namely, {44×(a+c)/(molecular mass of alkylene oxide of carbon number 4 or more)×b} is from 80/20 to 94/6. Further, value of c/(a+c) is 0.5 or more and less than 1.0.]

By using such a hydrophilic resin, it is possible to provide an inkjet recording material which is excellent in ink absorption capacity and productivity.

In the second aspect of the invention, the mass ratio between the hydrophilic resin and the plasticizer component in the ink receiving layer is preferably from 65:35 to 85:15.

The third aspect of the present invention provides a display material comprises the inkjet recording material described above; and other material to which the ink receiving layer of the inkjet recording material is adhered by hot-melt adhesion.

The fourth aspect of the present invention provides a method for producing a display material, comprises the steps of: printing on an ink receiving layer of any one of the above inkjet recording materials; and adhering the printed ink receiving layer to the other material by hot-melt adhesion.

In the inkjet recording material of the present invention, by making the ink receiving layer with a resin which is a blend of the hydrophilic resin, and hydrophobic resin having hot-melt adhesive property in particular ratio, it is capable of exhibiting high ink absorption capacity with the hydrophilic resin, and excellent moisture resistance adhesiveness with adhesive property and hydrophobic property of the hydrophobic resin. Further, by controlling the melting point and melting energy of the resin constituting the ink receiving layer within a predetermined range, it is possible to provide an inkjet recording material which is capable of having high adhesive strength even at the time of printing with high concentration of pigment ink.

DETAILED DESCRIPTION OF THE INVENTION

Figure 1A:
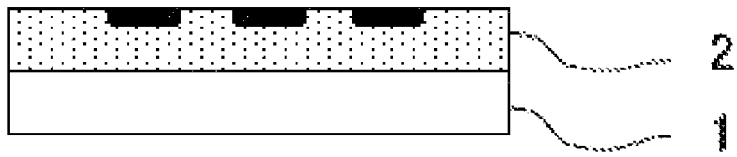
FIGS. 1A and 1B are schematic cross-sectional views showing a configuration of the inkjet recording material.

Hereinafter, the invention is described based on the embodiment shown in the drawing.

Figure 1B:
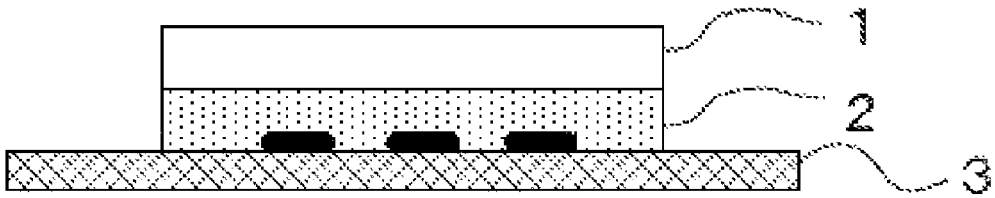

FIG. 1 is a schematic cross-sectional view showing a configuration of an inkjet recording material of the present invention. The inkjet recording material of the invention, as shown in FIG. 1A, has a configuration that a base layer 1 is laminated with an ink receiving layer 2. A recording material (A) where an image is mirror-likely printed on the ink receiving layer 2 is overlapped with the surface of other material 3 in a condition that the ink receiving layer 2 side is facing the other material 3, and is thermally adhered to an other material 3, so as to obtain a display material (B). In the display material (B), the base layer 1 acts as a protective layer of the printed ink receiving layer 2.

The base layer 1 acts as a supporting body of the ink receiving layer 2 at the time of printing by inkjet printer. After the ink receiving layer 2 is adhered with the other material 3, the base layer 1 also acts as a protective layer of the ink receiving layer 2. The base layer 1 needs to be transparent in order to recognize the image recorded in the ink receiving layer 2 through the base layer 1, it is not necessarily completely transparent. If it has a certain transparency which is enough to recognize the image in the ink receiving layer 2 through the base layer 1, the base layer 1 may be colored. Examples of resin suitably used as the base layer 1, from the view point of workability, weatherability, and so on, include biaxial-stretched polyester, acrylic resin, polyvinyl chloride, polycarbonate, and the like. The thickness of base layer 1 is preferably 25 μm or more from the view point of strength, and is preferably 100 μm or less in consideration of heat conductance to the ink receiving layer 2 at the time of heating.

The ink receiving layer 2 is composed of mixture of a hydrophilic component containing a hydrophilic resin and a hydrophobic resin having hot-melt adhesive property. If too much hydrophilic component exists in the mixture, hydrophilic part in the ink receiving layer 2 overwhelms, that causes a decline of adhesive strength at the time of moisture absorption. On the other hand, if too much hydrophobic resin exists, a decline of ink absorption property is caused. Therefore, the blending ratio (mass ratio) between the hydrophilic component and the hydrophobic resin having hot-melt adhesive property in the ink receiving layer 2 is preferably from 60:40 to 20:80 (hydrophilic component:hydrophobic component), more preferably, from 50:50 to 45:55 (hydrophilic component:hydrophobic component).

The melting point of the resin composing the ink receiving layer 2 is preferably from 40° C. to 55° C. and the melting energy of the same is preferably from 60 J/g to 90 J/g. In such a circumstance, the ink receiving layer is preferably composes of a mixture of a hydrophilic resin having hot-melt adhesive property, and a plasticizer component. In the ink receiving layer 2, the mixing ratio (mass ratio) between the hydrophilic resin having hot-melt adhesive property, and the plasticizer component is preferably from 65:35 to 85:15 (hydrophilic component:plasticizer component), more preferably, from 75:25 to 85:15 (hydrophilic component:plasticizer component).

The melting point of the resin composing the ink receiving layer 2 can be measured by DSC (differential scanning calorimerty). Moreover, the melting energy of the resin composing the ink receiving layer 2 can also be measured by DSC (differential scanning calorimerty).

Display materials these days have larger quantity of ink injection than ever before in order to enhance the sharpness and coloration thereof. Also, from the view point of durability of ink itself (color fading, blurring, and so on), pigment ink is often used. If dye ink is used, the ink component can be absorbed in the ink receiving layer 2, thereby there is less effect of the large ink quantity on the adhesive property. However, when pigment ink is used, a pigment ink layer occurs on the printing surface. Therefore, in case of the ink receiving layer 2 to be adhered with the other material 3, the ink receiving layer 2 needs to reach the other material 3 through the pigment ink layer.

In other words, under the laminator setting condition, i.e. temperature from 100° C. to 140° C., and line speed from 3 mm/sec to 20 mm/sec, viscosity of the ink receiving layer 2 needs to be sufficiently declined and the ink receiving layer 2 needs to contact with other material 3 through the pigment ink layer.

In the invention, the above problems are solved by setting the melting point and melting energy of the resins composing the ink receiving layer 2 within the abovementioned range. By doing this, even when a large quantity of pigment ink is injected, it becomes possible to adhere the ink receiving layer 2 to the other material 3 by hot-melt adhesion.

When the melting point of the resin composing the ink receiving layer 2 is too high, the melting of ink receiving layer 2 under the normal laminating condition becomes difficult. Thereby, hot-melt adhesion of the ink receiving layer 2 to the other material 3 becomes difficult. Further, when the melting energy is too high, afterheat of the laminator is consumed by melting of the crystal of resin composing the ink receiving layer 2, viscosity of the ink receiving layer 2 is not lowered. Furthermore, even though the crystal of resin composing the ink receiving layer 2 is successfully melted, if viscosity of the ink receiving layer 2 is high, the ink receiving layer 2 cannot go through the pigment ink layer.

While, in the opposite way, if the melting point of the resin composing the ink receiving layer 2 is too low; problems such that the inkjet recording material needs to be cooled at the time of storage and transportation occur. In addition, if the melting energy of the resin composing the ink receiving layer 2 is too low, the heat resistance problems occur at the completion of a display material after lamination with the other material 3.

Examples of hydrophilic resin used for the ink receiving layer 2 include polyvinyl alcohol, polyvinyl pyrrolidone, carboxymethyl cellulose, polyalkylene oxide, or the mixture thereof. Among them, as a hydrophilic resin which is excellent in ink absorption capacity and which enables to become a film by dry-type method such as extruding method excellent in productivity, polyethylene oxide is suitably used. In the invention, it is preferable to use a polyethylene oxide type hydrophilic resin as a main resin composed of a repeating unit represented by the general formula (1). For a hydrophilic resin having hot-melt adhesive property composing the ink receiving layer 2, it is preferable to use a polyethylene oxide type hydrophilic resin composed of a repeating unit represented by the general formula (1).

$$-\!\!\left[A^1X^1A^1R^1\right]\!\!- \quad (1)$$

In the general formula (1), $X^1$ is a residue of an organic compound having two activated hydroxyl groups, examples thereof are ethylene glycol, propylene glycol, bisphenol A, aniline propylene glycol, polytetramethylene glycol, and so on. $R^1$ is a dicarboxylic compound residue or a diisocyanate type compound residue. As a dicarboxylic compound, cyclic dicarboxylic compound or straight-chain dicarboxylic compound is desirable; examples thereof are dicarboxylic acid, dicarboxylic anhydride, and lower alkylester of dicarboxylic acid.

As the above dicarboxylic acid, phthalic acid, isophthalic acid, terephthalic acid, malonic acid, succinic acid, sebacic acid, maleic acid, fumaric acid, adipic acid, itaconic acid can be exemplified. While, as the above dicarboxylic anhydride, anhydride of the above respective dicarboxylic acids can be exemplified. Further, as lower alkylester of the above dicarboxylic acid, methylester, dimethylester, ethylester, diethylester, propylester, dipropylester, and so on of the above respective dicarboxylic acids can be exemplified. Particularly, straight-chain dicarboxylic acid having carbon number from 12 to 36 and low alkylester thereof are preferably exemplified; and the examples thereof are 1,10-decamethylene dicarboxylic acid, 1,14-tetradecamethylene dicarboxylic acid, 1,18-octadecamethylene dicarboxylic acid, 1,32-dotriacontanemethylene dicarboxylic acid, and so on.

Examples of diisocyanate type compound residues include 4,4'-diphenylmethane diisocyanate, toluene diisocyanate, xylenediisocyanate, hexamethylene diisocyanate, isophorone dilsocyanate, and the like.

Among the above examples, As $R^1$, from the view point of reactivity, the above dicarboxylic acid anhydrate and lower alkylester of dicarboxylic acid are preferably used. These may be used alone or in combination with two or more thereof.

Also, $A^1$ is represented by the following general formula (2).

$$-(CH_2CH_2O)_a-(CH_2\overset{\overset{Z}{|}}{C}HO)_b-(CH_2CH_2O)_c- \quad (2)$$

In the formula (2), Z is a hydrocarbon group of carbon number 2 or more, preferable examples are alkyl group such as ethyl and propyl. a, b, and c each is an integer number 1 or more; and a mass ratio calculated with a, b, and c, namely, {44×(a+c)/(molecular mass of alkylene oxide of carbon number 4 or more)×b} is from 80/20 to 94/6. When the value is smaller than 80/20, it is still possible to use as the above hydrophilic resin. However, in such a case, problems like declines of hydrophilic property, or poor performance of ink absorption property and printing suitability occur. On the other hand, when the value is more than 94/6, it is also still possible to use as the above hydrophilic resin. However, a problem of poor performance of ink blurring water resistance occurs. By setting the ratio between a, b, and c within the above range, the resin can be hydrophilic but also insoluble against water. Further, value of c/(a+c) is set in the range of from 0.5 or more to less than 1.0.

Such thermoplastic resin can be made such that: ethylene oxide is addition-polymerized to ethylene glycol; alkylene oxide is addition-polymerized thereto; ethylene oxide is further addition-polymerized thereto; and a dicarboxylic acid compound is added to the obtained polyalkylene oxide.

As material resin used for the ink receiving layer 2, if a resin having functional groups reactive with water is used, intermolecular cross-linking reaction is occurred; thereby it is preferable to use such a resin to make an inkjet recording material which is excellent in moisture resistance. Examples of such functional group include alkoxysilane group and silanol group.

Examples of the hydrophobic resin having hot-melt adhesive property used for ink receiving layer 2 includes: ethylene-vinyl acetate copolymer, ethylene-acrylic acid copolymer, ethylene-ethyl acrylate copolymer, polyamide, polyester, rosin-type and pinene-type polymers, acid-modified compound such as acid-modified polyolefin and the like; and the mixture, derivatives, copolymer, modification, and so on thereof. Among them, from the view point of adhesiveness, ethylene-vinyl acetate copolymer, polyester, ethylene-acrylic acid copolymer, ethylene-ethyl acrylate copolymer are preferable, from the similar point of view, acid-modified compound such as acid-modified polyolefin are also preferably used.

The plasticizer component composed in the ink receiving layer 2 is preferable in high compatibility with hydrophilic resin having hot-melt adhesive property. And, as a whole mixture of the hydrophilic resin having hot-melt adhesive property and the plasticity component, it is also preferable to have the melting point and the melting energy within the above range. The plasticizer component is preferably in solid state in the room temperature in order to prevent bleed-out. When the plasticizer components bleed-out, the adhesive property of the ink receiving layer 2 to the other material 3 declines. As the plasticizer component, in particular, resins such as ethylene-vinyl acetate copolymer, ethylene-ethyl acrylate copolymer are suitably used.

If the content of the plasticizer component is out of the above mass ratio between the hydrophilic resin and the plasticizer component in the ink receiving layer 2 to become too large, due to the problems of printing performance and dispersion, appearance of the display material becomes worse. While, if the content of the plasticizer is too small, the effect to lower the melting energy of the resin composing the ink receiving layer 2 is low, thereby the adhesive property of the ink receiving layer 2 to the other material 3 does not improve.

It is not certain, but, in the ink receiving layer 2 of the invention, it is assumed that the hydrophobic resin having hot-melt adhesive property forms a sea-part, and the hydrophilic resin forms an island-part in the sea-island structure. By comprising hydrophilic resin and hydrophobic resin each other in a different form, it is possible for them each to separate the roles of ink absorbent property and adhesive-property. Accordingly, the inventors assume as follows. When the hydrophobic component is defined as the sea structure; the hydrophilic resin as the island structure plays a role of ink absorbent property. While, the hydrophobic resin as a matrix can maintain the adhesive property even at the absorbing time of the ink receiving layer 2.

The ink receiving layer 2 of the invention, in order to enhance the structural bound strength between the hydrophilic resin and hydrophobic resin having hot-melt adhesive property, preferably forms cross-linked structure. The method to form the cross-linked structure includes a treatment with radiating ray like electron ray, ultraviolet ray, gamma ray after blending the resin. Among them, it is effective and preferable to adopt a method to radiate ultraviolet ray for cross-liking the blended resin to which hydrogen abstraction type photo-radical polymeric initiator is added. Hydrogen abstraction type photo-radical polymeric initiators are photo-radical polymeric initiators that produce radicals by abstracting hydrogen from other molecules. Hydrogen abstraction type photo-radical polymeric initiators preferably used in the invention includes any one of benzophenone derivatives selected from the group consisting of: benzil, o-benzoyl methyl benzoate, 2,4,6-trimethyl benzophenone, 4-methylbenzophenone, acrylic benzophenone, thioxamthone, 3-ketocoumarin, 2-ethyl anthraquinone, camphorquinone, Michler's ketone, tetra (t-butylperoxy carbonyl)benzophenone, or a mixture of two or more thereof. Mixtures with cleavage-type photo-radical polymeric initiators and the like can be also used. As particularly preferable hydrogen abstraction type photo-radical polymeric initiators, from the view point of transparency and hardening, benzophenone type compounds are used. The additive amount thereof is appropriately adjusted according to the thickness of the ink receiving layer 2 or the condition of ultraviolet ray radiation. However, from the view point of progressive in cross-linking, the additive amount is preferable to be 0.01% by mass or more for 100% by mass of hydrophilic resin; from the view point of temporal stability, it is preferable to be 10% by mass or less for 100% by mass of hydrophilic resin. In consideration with thick film hardening, transparency, and temporal stability, the additive amount is particularly preferable in the range from 0.05% by mass to 2.0% by mass.

To the ink receiving layer 2, various additives can be added as needed. Among them, it is preferable to add porous inorganic particles to enhance the ink absorption property. The porous inorganic particles include inorganic particles generally used for void-type inkjet recording material such as silica group like nano-porous silica and meso-porous silica, and alumina. Silica and alumina may be added in a form of mixture thereof. Further, the additive amount of inorganic particles are preferably from 5% by mass to 70% by mass for the total mass of the ink receiving layer 2 as the standard (100% by mass).

Also, to the ink receiving layer 2, cationic resin may be added for the purpose to improve the blurring property and fixing property of the ink. Examples of suitably used cationic resin include polymer compound such as copolymer composed of monomers having quaternary amine groups such as polyallylamine hydrochloride and polyalkyl aminoacrylate. The additive amount of cationic resin is preferably from 5% by mass to 50% by mass for the total mass of ink receiving layer 2 as the standard (100% by mass). Besides, low melting-energy resins such as ethylene-vinyl acetate copolymer, ethylene-ethyl acrylate copolymer may be blended and then added to the cationic resin. By adding the low melting-energy resins, the adhesive property between the ink receiving layer 2, the base layer 1 and the other material 3 can be improved. Any additives other than the above additives may be added to the ink receiving layer 2. Examples of the other additives include antioxidant like tocopherol and butylhydroxy anisole, and silane coupling agent.

The inkjet recording material of the invention can be produced by applying the ink receiving layer 2 onto the base layer 1, or thermally adhering the base layer 1 and the ink receiving layer 2 each other respectively formed in advance. The inkjet recording material of the invention can be also produced by extrusion forming of the ink receiving layer 2 on a resin film of the base layer 1 and laminating the ink receiving layer 2 at the same time. This production method is simple, and preferable method which enables to produce high quality recording materials. The preferable production method is described in detail as follows. For example, a hydrophilic resin and a hydrophobic resin having hot-melt property are blended with use of biaxial-kneading extruder. Thereafter, the blended material is melt-molded by T-type manifold dies, and laminated with a film becoming the base layer 1 by nip roll at the same time as the melt-molding. This is how the laminated film for inkjet recording material is obtained. Further, if ultraviolet lamps are disposed on the production line, cross-linking described above is also realized at the same time.

EXAMPLES

The examples of the present invention are described as follows; however the invention is not limited by the examples.

Preparation of Test Piece of Evaluation

Example 1

Ethylene oxide was addition-polymerized to ethylene glycol, butylene oxide was addition-polymerized thereto, further, ethylene oxide was addition-polymerized thereto to obtain polyalkylene oxide. And octadecan-1,18-methyl dicarboxylate was added to the obtained polyalkylene oxide for ester exchange reaction, so as to obtain a resin A of weight-average molecular weight 150,000. Then, 1 part by mass of tocophenol (produced by BASF, UVINUL2000AO) was added as a thermal stabilizer to the resin A, (45 parts by mass of the mixture) and 55 parts by mass of a resin B (ethylene-vinyl acetate copolymer (including 15~40% by mass of vinyl acetate, melting-index 300)) were melt-kneaded by biaxial-kneading extruder; and the melt-kneaded material was melt-molded into 30 μm film by T-type manifold dies; then, it was laminated with biaxial-stretched polyester film (produced by Mitsubishi Polyester Film Corporation, T600E, 50 μm) used as a base layer by nip roll at the same time as the melt-molding. Thus, a laminated film for inkjet recording material was obtained.

Example 2

The same operations as in Example 1 were performed to make a laminated film except for adding 0.5 parts by mass benzophenone as a hydrogen abstraction type photo-radical polymeric initiator to the resin A, then radiating light of 3600 mJ/cm$^2$ of single-side accumulated light intensity by high-pressure mercury lamp through the base layer.

Example 3

45 parts by mass of resin C (porous silica (produced by Mizusawa Chemical Co., Ltd., Mizucasile P78A) was mixed with polyvinyl alcohol (produced by Kuraray Co., Ltd., CP-1000) at the ratio (mass ratio) of 50:50) and 65 parts by mass of the resin B were melt-kneaded by biaxial-kneading extruder. Then, it was melt-molded into 30 μm by T-type manifold dies, and laminated with biaxial-stretched polyester film (produced by Mitsubishi Polyester Film Corporation, T600E, 50 μm) used as a base layer by nip roll at the same time as the melt-molding. Thus, a laminated film for inkjet recording material was obtained.

Comparative Example 1

The same operations as in Example 1 were performed to make a laminated film except for changing the ratio of the resin A and the resin B of the Example 1 into 25:75.

Comparative Example 2

The same operations as in Example 1 were performed to make a laminated film except for changing the ratio of the resin A and the resin B of the Example 1 into 65:35.

Comparative Example 3

The same operations as in Example 1 were performed to make a laminated film except that resin B was not added in the Example 1.

<Evaluation of the Test Piece>

Test pieces, which were made according to the above Examples 1 to 3 and the Comparative Examples 1 to 3, were evaluated based on the following criteria. Each evaluation method is as follows. The evaluated result is shown in Table 1.

(Printing Quality Evaluation)

Printing was made to each test piece with use of a printer "Design jet 5500" produced by Hewlett-Packard Company, and the printing quality of the printed test pieces were sensory evaluated by eyes. The printing was done under 100% setting of ink injection amount (normal injection amount) and 300% setting of ink injection amount (three times of normal injection amount). 3 centimeters square patches in red, blue, yellow and black were printed so as to adjoin each other, blurring and unevenness of the printing at the border areas were evaluated as follows.

◎: Border lines between each color are clear and no unevenness can be seen;

○: Border lines between each color are clear and a slight unevenness can be seen; and X: Colors flowed over the border lines and unevenness can be seen.

(Moisture Resistance Adhesive Property Test)

By using heat laminator (produced by Lami Corp. Inc., Lamimonkey), the surface of ink receiving layer of each test piece was thermally laminated to the polyvinyl chloride plastic plate (3 mm thick) at the temperature of 100° C. The obtained laminated test pieces were stood-still for 120 hours under the condition of temperature 40° C., humidity 90%; thereafter, laminate strength of the test pieces were measured. The laminate strength was measured by T-type de-lamination test with use of tensile testing machine.

TABLE 1

| | Example 1 | Example 2 | Example 3 | Comparative Example 1 | Comparative Example 2 | Comparative Example 3 |
|---|---|---|---|---|---|---|
| Printing quality evaluation (100%) | ◎ | ◎ | ◎ | X | ◎ | ◎ |
| Printing quality evaluation (300%) | ◎ | ◎ | ○ | X | ◎ | ◎ |
| Laminate strength (mN/cm) | 5 or more | 5 or more | 5 or more | 5 or more | 2 or less | 2 or less |

The inkjet recording material of the invention (Examples 1 to 3) were excellent in printing quality and in moisture resistance adhesive property as the laminate strength was large under the high humidity condition. On the other hand, the Comparative example 1 having too low ratio of hydrophilic resin was inferior in printing quality to the Examples 1 to 3; further, the Comparative example 2 having too high ratio of hydrophilic resin and the Comparative example 3 having only hydrophilic resin had small laminate strength under the high humidity condition. Thereby moisture resistance adhesive property was inferior to that of Examples 1 to 3.

Example 4

As a hydrophilic resin having hot-melt adhesive property, 80 parts by mass of the resin A and 20 parts by mass of plasticizer component (HPRVR105, produced by Du Pont-Mitsui Polychemicals Co., Ltd.) were melt-kneaded with biaxial-kneading extruder; and then, the melt-kneaded material was melt-molded into 30 μm thick film by T-type manifold dies. At the same time as the melt-molding, it is laminated with biaxial-stretched polyester film (produced by Mitsubishi Polyester Film Corporation, T600E, 50 μm) used as a base layer by nip roll. Thus, a laminated film for inkjet recording material was obtained.

Example 5

The same operations as in Example 4 were performed to obtain a laminated film to become the inkjet recording material except for using NUC6090 (produced by Nippon Unicar Company Limited) as a plasticizer component.

Comparative Example 4

The same operations as in Example 4 were performed to obtain a laminated film to become the inkjet recording material except for using the resin A only without mixing plasticizer component.

Comparative Example 5

The same operations as in Example 5 were performed to obtain a laminated film to become the inkjet recording material except for mixing 60 parts by mass of the resin A and 40 parts by mass of NUC6090 (produced by Nippon Unicar Company Limited) as a plasticizer component in Example 5.

Comparative Example 6

The same operations as in Example 5 were performed to obtain a laminated film to become the inkjet recording material except for mixing 90 parts by mass of the resin A and 10 parts by mass of NUC6090 (produced by Nippon Unicar Company Limited) as a plasticizer component in Example 5.

<Evaluation of Test Pieces>

The above described test pieces based on Examples 4 and 5 as well as Comparative examples 4 to 6 were evaluated as below. Each evaluation method is as follows. The evaluation result is shown in table 2. The melting point of resin composing the ink receiving layer was measured by DSC (differential scanning calorimerty); the melting energy was measured by DSC (differential scanning calorimerty). The results are also shown within table 2.

(Printing Quality Evaluation)

Printing was made with pigment black ink to each ink receiving layer of test pieces with use of a printer "PX-9000" produced by Seiko Epson Corporation. The printing was set via a printing setting software "PS ripper, kind of the printing paper was set "MC photo paper", and resolution was set "2880 dpi×1440 dpi"; the printing was done allover the ink receiving layer with ink in highest concentration. After drying the printed paper, each test piece was laminated to a 2 mm thick PVC board under the condition of temperature 120° C. and line speed 5 mm/sec. And the printing quality of the obtained display materials were evaluated by eyes based on the following criteria.

◎: Border lines between each color are clear and no unevenness can be seen;

○: Border lines between each color are clear and a slight unevenness can be seen; and X: Colors flowed over the border lines and unevenness can be seen.

(Adhesive Strength)

With the produced display material, 900 de-lamination test was done according to JIS K 6854 so as to measure the adhesive strength.

(Appearance Evaluation)

The appearance of each sheet was evaluated by eyes.

○: Unevenness and streaks are not seen at all;

X: Unevenness and streaks can be seen.

TABLE 2

| | Example 4 | Example 5 | Comparative Example 4 | Comparative Example 5 | Comparative Example 6 |
|---|---|---|---|---|---|
| Melting point (° C.) | 52 | 51 | 53 | 51 | 53 |
| Melting energy (ΔHm) (J/g) | 85 | 78 | 102 | 68 | 92 |
| Printing quality evaluation | ◎ | ◎ | ◎ | X | ◎ |
| Adhesive strength (N/cm) | 11.8 | 10.8 | 1.96 | 11.8 | 2.94 |
| Appearance | ○ | ○ | ○ | X | ○ |

The inkjet recording material of the invention (Examples 4 and 5) were excellent in printing quality, and had large adhesive strength. While, Comparative example 4 to which the plasticizer component was not added, the adhesive strength was small. Further, Comparative example 5, wherein ratio of the plasticizer was too high, had a poor printing quality. On the other hand, Comparative example 6 wherein the ratio of the plasticizer is too low had a small adhesive strength.

The above has described the present invention associated with the most practical and preferred embodiments thereof. However, the invention is not limited to the embodiments disclosed in the specification. Thus, the invention can be appropriately varied as long as the variation is not contrary to the subject substance and conception of the invention which can be read out from the claims and the whole contents of the specification. It should be understood that inkjet recording material with such an alternation are included in the technical scope of the invention.

INDUSTRIAL APPLICABILITY

The inkjet recording material of the present invention has high ink absorption capacity and is excellent in moisture resistance adhesiveness. It can also be used as an inkjet recording material having high adhesive strength when a large amount of pigment ink is injected. Having such preferable characteristics, the inkjet recording material can be preferably used for the application of display materials used under a harsh environment which requires to have high ink concentration and tone so as to be seen well from the distance.

The invention claimed is:

1. An inkjet recording material comprising at least a base layer and an ink receiving layer, wherein said ink receiving layer comprises a mixture of a hydrophilic component comprising a hydrophilic resin and a hydrophobic resin having hot-melt adhesive property, and the mass ratio between said hydrophilic component and said hydrophobic resin having hot-melt adhesive property in the mixture is from 60:40 to 20:80, wherein said hydrophilic resin is a resin composed of a repeating unit represented by the following general formula (1);

$$-[A^1X^1A^1R^1]- \quad (1)$$

wherein in the formula (1), $X^1$ is a residue of an organic compound having two activated hydroxyl groups, $R^1$ is a dicarboxylic compound residue or a diisocyanate type compound residue, and $A^1$ is represented by the following general formula (2);

$$-(CH_2CH_2O)_a-(CH_2\overset{\overset{Z}{|}}{C}HO)_b-(CH_2CH_2O)_c- \quad (2)$$

wherein in the formula (2), Z is a hydrocarbon group of carbon number 2 or more; a, b, and c each is an integer number 1 or more; and a mass ratio calculated with a, b, and c, namely, {44×(a+c)/(molecular mass of alkylene oxide of carbon number 4 or more)×b} is from 80/20 to 94/6, and the value of c/(a+c) is 0.5 or more and less than 1.0.

2. An inkjet recording material according to claim 1, wherein said hydrophilic resin is at least one resin selected from the group consisting of polyvinyl alcohol, polyvinyl pyrrolidone, carboxymethyl cellulose, or mixture of two or more resins thereof.

3. An inkjet recording material according to claim 1 wherein said hydrophobic resins having hot-melt adhesive property is at least one resin selected from the group consisting of ethylene-vinyl acetate copolymer, polyester, ethylene-acrylic acid copolymer, ethylene-ethyl acrylate copolymer, or mixture of two or more resins thereof.

4. An inkjet recording material according to claim 1, wherein said hydrophilic component comprises porous inorganic particles.

5. An inkjet recording material according to claim 4, wherein said porous inorganic particles are silica and/or alumina.

6. An inkjet recording material according to claim 1, wherein said ink receiving layer comprises cationic resin.

7. A display material comprising: an inkjet-recording material described in claim 1; and other material to which said ink receiving layer of said inkjet recording material is adhered by hot-melt adhesion.

8. A method for producing a display material, comprising: printing on an ink receiving layer of an inkjet recording material described in claim 1; and adhering said printed ink receiving layer to other material by hot-melt adhesion.

9. An inkjet recording material comprising at least a base layer and an ink receiving layer, wherein the melting point of resin composing said ink receiving layer is between 40° C. and 55° C., and melting energy of the same is between 60 J/g and 90 J/g.

10. An inkjet recording material according to claim 9, wherein said ink receiving layer is a mixture of a hydrophilic resin having hot-melt adhesive property, and a plasticizer component.

11. An inkjet recording material according to claim 10, wherein said hydrophilic resin having hot-melt adhesive property is a resin comprising a repeating unit represented by the following general formula (1);

$$-\!\!\left[A^1X^1A^1R^1\right]\!\!- \quad (1)$$

wherein in the formula (1), $X^1$ is a residue of an organic compound having two activated hydroxyl groups, $R^1$ is a dicarboxylic compound residue or a diisocyanate type compound residue, and $A^1$ is represented by the following general formula (2);

$$-\!\!\left(CH_2CH_2O\right)_a\!\!-\!\!\left(CH_2\overset{\overset{\displaystyle Z}{|}}{C}HO\right)_b\!\!-\!\!\left(CH_2CH_2O\right)_c\!\!- \quad (2)$$

wherein in the formula (2), Z is a hydrocarbon group of carbon number 2 or more; a, b, and c each is an integer number 1 or more; and a mass ratio calculated with a, b, and c, namely, {44×(a+c)/(molecular mass of alkylene oxide of carbon number 4 or more)×b} is from 80/20 to 94/6 and the value of c/(a+c) is 0.5 or more and less than 1.0.

12. An inkjet recording material according to claim 10, wherein the mass ratio between said hydrophilic resin and said plasticizer component in said ink receiving layer is from 65:35 to 85:15.

13. A display material comprising: an inkjet recording material described in claim 9; and other material to which said ink receiving layer of said inkjet recording material is adhered by hot-melt adhesion.

14. A method for producing a display material, comprising: printing on an ink receiving layer of an inkjet recording material described in claim 9; and adhering said printed ink receiving layer to other material by hot-melt adhesion.

15. An inkjet recording material comprising at least a base layer and an ink receiving layer, wherein said ink receiving layer comprises a mixture of a hydrophilic component comprising a hydrophilic resin and a hydrophobic resin having hot-melt adhesive property, and the mass ratio between said hydrophilic component and said hydrophobic resin having hot-melt adhesive property in the mixture is from 60:40 to 20:80, wherein said hydrophilic resin, and said hydrophobic resin having hot-melt adhesive property form a cross-linked structure.

16. An inkjet recording material according to claim 15, wherein said hydrophilic resin is at least one resin selected from the group consisting of polyvinyl alcohol, polyvinyl pyrrolidone, carboxymethyl cellulose, or mixture of two or more resins thereof.

17. An inkjet recording material according to claim 15, wherein said hydrophobic resins having hot-melt adhesive property is at least one resin selected from the group consisting of ethylene-vinyl acetate copolymer, polyester, ethylene-acrylic acid copolymer, ethylene-ethyl acrylate copolymer, or mixture of two or more resins thereof.

18. An inkjet recording material according to claim 15, wherein said hydrophilic component comprises porous inorganic particles.

19. An inkjet recording material according to claim 15, wherein said ink receiving layer comprises cationic resin.

20. An inkjet recording material according to claim 15, wherein said cross-linked structure is formed by adding from 0.1% by mass to 10% by mass of hydrogen abstraction type photo-radical polymeric initiator and by radiating ultraviolet-ray thereafter.

21. A display material comprising: an inkjet-recording material described in claim 15; and other material to which said ink receiving layer of said inkjet recording material is adhered by hot-melt adhesion.

22. A method for producing a display material, comprising: printing on an ink receiving layer of an inkjet recording material described in claim 15; and adhering said printed ink receiving layer to other material by hot-melt adhesion.

* * * * *